US007992962B2

(12) United States Patent
Oki

(10) Patent No.: US 7,992,962 B2
(45) Date of Patent: Aug. 9, 2011

(54) LIQUID EJECTING APPARATUS

(75) Inventor: Narihiro Oki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 1003 days.

(21) Appl. No.: 11/852,083

(22) Filed: Sep. 7, 2007

(65) Prior Publication Data

US 2008/0062220 A1 Mar. 13, 2008

(30) Foreign Application Priority Data

Sep. 8, 2006 (JP) ..... 2006-244716

(51) Int. Cl.
*B41J 2/165* (2006.01)

(52) U.S. Cl. ..... 347/31

(58) Field of Classification Search ..... 347/31
See application file for complete search history.

(56) References Cited

FOREIGN PATENT DOCUMENTS

JP 2006-224384 8/2006

*Primary Examiner* — Kevin S Wood
(74) *Attorney, Agent, or Firm* — Maschoff Gilmore & Israelsen

(57) ABSTRACT

A liquid ejecting apparatus includes a liquid ejecting head, a platen, an absorption member, an electrode, a potential difference generating device. The liquid ejecting apparatus that adheres liquid, which is discharged from openings of a nozzle plate mounted on a liquid ejecting head, to a recording object. The potential difference generating device generates a difference in potential between the nozzle plate and the electrode by applying voltage to the electrode so as to form an electric field, whereby liquid ejected from the liquid ejecting head is electrically attracted toward the electrode. In this manner, it is possible to prevent the electrode and the absorption member from being lifted using components of the existing platen body.

6 Claims, 16 Drawing Sheets

LIQUID EJECTING APPARATUS

BACKGROUND

1. Technical Field

The present invention relates to a liquid ejecting apparatus, a platen and a recording apparatus. More specifically, the invention relates to a liquid ejecting apparatus that adheres liquid, which is discharged from openings of a nozzle plate mounted on a liquid ejecting head, to a recording object.

2. Related Art

When a liquid ejecting apparatus adheres liquid to a recording object without any remaining margin at the periphery of the recording object, the liquid ejecting apparatus ejects liquid toward an area slightly larger than the size of the recording object in view of an inevitable positional deviation between the recording object and a liquid ejecting head. Thus, liquid is also ejected toward an area where a recording object is not present in proximity to the side peripheries and front and rear peripheries of the recording object. Then, an absorption member is arranged at a position opposed to the liquid ejecting head and located farther from the liquid ejecting head than the recording object, and the absorption member absorbs liquid that has been ejected but not adhered to the recording object. This prevents a stain from adhering to around the recording object due to liquid that has not adhered to the recording object.

In the meantime, when liquid is adhered to a recording object, the recording object may possibly form wrinkles because a portion to which the liquid is adhered may possibly expand. If the wrinkles contact the absorption member, liquid that has been absorbed by the absorption member stains the recording object. Then, in most of the liquid ejecting apparatuses, in view of the heights of wrinkles formed in the recording object, a clearance of about 2 to 4 mm is provided between the recording object and the absorption member. For the same purpose of preventing a stain due to contact, a clearance of about 1 mm is provided between the nozzle plate and the recording object. Thus, about 3 to 5 mm clearance is provided between the nozzle plate and the absorption member.

On the other hand, for the purpose of improving resolution of an image that is formed on the recording object by liquid, liquid droplets discharged from the openings of the nozzle plate tend to become finer and finer. When focusing on a single liquid droplet, the amount of the liquid droplet is only about a few picoliter. These fine liquid droplets each have an extremely small weight, so that, when the liquid droplets are once discharged from the nozzle plate, they rapidly lose their kinetic energy due to the viscous drag of the atmosphere, or the like. For example, it has been proved that liquid droplets having an amount of less than 8 picoliter lose their velocity to substantially zero when they fly a distance of about 3 mm in the atmosphere. The fine liquid droplets that have thus lost kinetic energy need a relatively long time until they complete falling because falling motion due to gravitational acceleration becomes substantially equal to a viscous drag force of the atmosphere. Liquid droplets float in the air until they complete falling. These liquid droplets are termed as aerosols.

Some of the thus produced aerosols float to the outside of the liquid ejecting apparatus and adhere to a peripheral area. In addition, most of the aerosols adhere to portions within the liquid ejecting apparatus. When the aerosols adhere to a path, such as a platen, along which a recording object is transported, a recording object that will be transported for the next time is stained because the aerosols adhere again to the next recording object. Further, when the aerosols are adhered to an electrical circuit, a linear scale, a rotary encoder, an optical sensor, or the like, which are mounted in the liquid ejecting apparatus, it may cause malfunction of the liquid ejecting apparatus itself. Furthermore, when a user touches the portions to which the aerosols are adhered, user's hand will be smeared with the aerosols.

Japanese Unexamined Patent Application Publication No. 2004-202867 describes a liquid ejecting apparatus that has the function of actively collecting aerosols using an electric field. In the liquid ejecting apparatus described therein, for the purpose of adhering and absorbing liquid droplets that have not adhered to a recording object, an absorption member is arranged at a position opposed to a nozzle plate. In addition, a metal component, which serves as a first electrode, is arranged on the surface of the absorption member, and a metal nozzle plate having openings for ejecting liquid is used as a second electrode.

When these electrode and nozzle plate are applied with different voltages, an electric field is generated therebetween. On the other hand, liquid droplets discharged from the nozzle plate, at the moment when the liquid droplets are discharged from the nozzle plate, will be charged with the same pole as that of the nozzle plate owing to a so-called lightning rod effect. Thus, fine liquid droplets, which may become aerosols, also continue flying toward the electrode without any deceleration owing to Coulomb attraction from the electric field and are then adsorbed by the electrode having an electric potential that is opposite in pole to those of their own electric charge. Furthermore, liquid droplets that are adsorbed by the electrode are absorbed by the absorption member, which is arranged in proximity to the electrode, by the action of capillarity.

As described above, it has been proved that it is possible to suppress production of aerosols by means of an electric field utilizing the aerosols being electrically charged. However, there is another technical problem to be solved because of another action of electric field that is generated in order to collect aerosols.

That is, when an electric field is formed, an electrostatic force that attracts the electrode, which applies voltage, toward the nozzle plate is applied to the electrode. When an electric field having a strength of about 50 to 250 kV/m is formed in order to effectively collect aerosols, an electrostatic force of 2 to 55 μN per square centimeters is applied to components arranged inside the electrode. On the other hand, because the electrode is generally formed of a thin plate material, the electrode is light in weight and low in deformation strength. For this reason, the electrode may partially be lifted up due to electrostatic force received from the electric field.

In addition, to arrange an absorption member in proximity to the electrode, it is likely that the absorption member is mounted on the electrode. For this reason, when the electrode is lifted up due to the action of electrostatic force, the absorption member may also be lifted up toward the nozzle plate.

Further, when the lifted electrode, the lifted absorption member, and the like, contact a recording object, the rear face of the recording object is stained with liquid that has been already absorbed by the absorption member. Moreover, when the recording object collides with the lifted absorption member from the side, it is likely that the absorption member drops off from a position where the absorption member is initially arranged.

SUMMARY

A first aspect of the invention provides a liquid ejecting apparatus. The liquid ejecting apparatus includes a liquid ejecting head, a platen, an absorption member, an electrode, a potential difference generating device. The liquid ejecting head has a conductive nozzle plate that has openings. The liquid ejecting head ejects liquid from the openings toward a front face of a recording object. The platen is arranged at a position opposed to the nozzle plate with the recording object placed between the platen and the nozzle plate. The platen contacts a rear face of the recording object to support the recording object. The absorption member is arranged at a position opposed to the nozzle plate and located farther from the openings than the recording object in a direction in which the liquid is ejected. The absorption member absorbs liquid that is ejected from the openings but not adhered to the recording object. The electrode is arranged in proximity to the absorption member. The potential difference generating device generates a difference in potential between the nozzle plate and the electrode by applying voltage to the electrode so as to form an electric field, whereby liquid ejected from the liquid ejecting head is electrically attracted toward the electrode. The platen includes a platen body, an accommodation portion and a retaining portion. The accommodation portion is depressed from the platen body and formed to include a bottom portion and a side wall portion. The accommodation portion accommodates the absorption member therein. The retaining portion retains the electrode, which is arranged along the bottom portion of the accommodation portion, toward the bottom portion. In this manner, it is possible to prevent the electrode and the absorption member from being lifted up due to the action of electric field. Thus, it is possible to form an electric field that is able to effectively collect aerosols.

In the above liquid ejecting apparatus, the retaining portion may include a protrusion that protrudes inward of the accommodation portion from portion of the side wall portion. The electrode may include a cutout portion that allows the retaining portion to pass therethrough. The electrode, after accommodated in the accommodation portion by passing the protrusion through the cutout portion, may be displaced along the bottom portion and then fitted between the bottom portion and the protrusion. In this manner, it is possible to form the above structure without increasing the number of components of the liquid ejecting apparatus. In addition, the number of assembling man-hours is not increased. Thus, it is possible to obtain the above advantageous effects without increasing costs.

In the above liquid ejecting apparatus, the retaining portion may include a protrusion that protrudes inward of the accommodation portion from portion of the side wall portion. The electrode, after once contacting the protrusion, may be pressed in so as to contact the bottom portion by overcoming elastic force of at least one of the electrode and the retaining portion and then held between the bottom portion and the retaining portion. In this manner, it is possible to form the above structure without increasing the number of components of the liquid ejecting apparatus. In addition, the number of assembling man-hours is not increased. Thus, it is possible to obtain the above advantageous effects without increasing costs.

In the above liquid ejecting apparatus, the retaining portion may be formed to extend from the bottom portion and, after inserted through a hole formed in the electrode, contact an upper face of the electrode by a top portion being deformed. In this manner, it is possible to form the above structure in low cost without increasing the number of components. In addition, because the tolerance relative to dimensional accuracy of components may be set large, design and manufacturing will be easy.

A second aspect of the invention provides a liquid ejecting apparatus. The liquid ejecting apparatus includes a liquid ejecting head, an absorption member, a platen, and a potential difference generating device. The liquid ejecting head has a conductive nozzle plate that has openings. The liquid ejecting head ejects liquid from the openings toward a front face of a recording object. The absorption member is arranged at a position opposed to the nozzle plate and located farther from the openings than the recording object in a direction in which the liquid is ejected. The absorption member absorbs liquid that is ejected from the openings but not adhered to the recording object. The platen is integrally formed with a platen body, an accommodation portion and an electrode. The accommodation portion is depressed from a surface of the platen body. The accommodation portion accommodates the absorption member therein. The electrode is at least partially embedded in a bottom portion of the accommodation portion. The platen is arranged at a position opposed to the nozzle plate with the recording object placed between the platen and the nozzle plate. The platen contacts a rear face of the recording object to support the recording object. The potential difference generating device generates a difference in potential between the nozzle plate and the electrode by applying voltage to the electrode so as to form an electric field, whereby liquid ejected from the liquid ejecting head is electrically attracted toward the electrode. In this manner, fixing the electrode is completed at the same time with forming the platen body. Actually, it is possible to prevent the electrode and the absorption member from being lifted while reducing the number of manufacturing processes.

A third aspect of the invention provides a liquid ejecting apparatus. The liquid ejecting apparatus includes a liquid ejecting head, an absorption member, a platen, an electrode and a potential difference generating device. The liquid ejecting head has a conductive nozzle plate that has openings. The liquid ejecting head ejects liquid from the openings toward a front face of a recording object. The absorption member is arranged at a position opposed to the nozzle plate and located farther from the openings than the recording object in a direction in which the liquid is ejected. The absorption member absorbs liquid that is ejected from the openings but not adhered to the recording object. The platen is integrally formed with a platen body and an accommodation portion. The accommodation portion is depressed from a surface of the platen body. The accommodation portion accommodates the absorption member therein. The platen is arranged at a position opposed to the nozzle plate with the recording object placed between the platen and the nozzle plate. The platen contacts a rear face of the recording object to support the recording object. The electrode is adhered to a bottom portion of the accommodation portion. The potential difference generating device generates a difference in potential between the nozzle plate and the electrode by applying voltage to the electrode so as to form an electric field, whereby liquid ejected from the liquid ejecting head is electrically attracted toward the electrode. In this manner, it is possible to prevent the electrode and the absorption member from being lifted using components of the existing platen body.

Note that the above overview of the aspects of the invention is not intended to describe all necessary features of the invention. Accordingly, the sub-combinations of these sets of features may also be aspects of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will now be described, but the following embodiments are not intended to limit the scope of the invention as set forth in the appended claims. In addition, it is not always necessary to include all the combinations of the features described in the embodiments for solution of the aspects of the invention.

Figure 1:
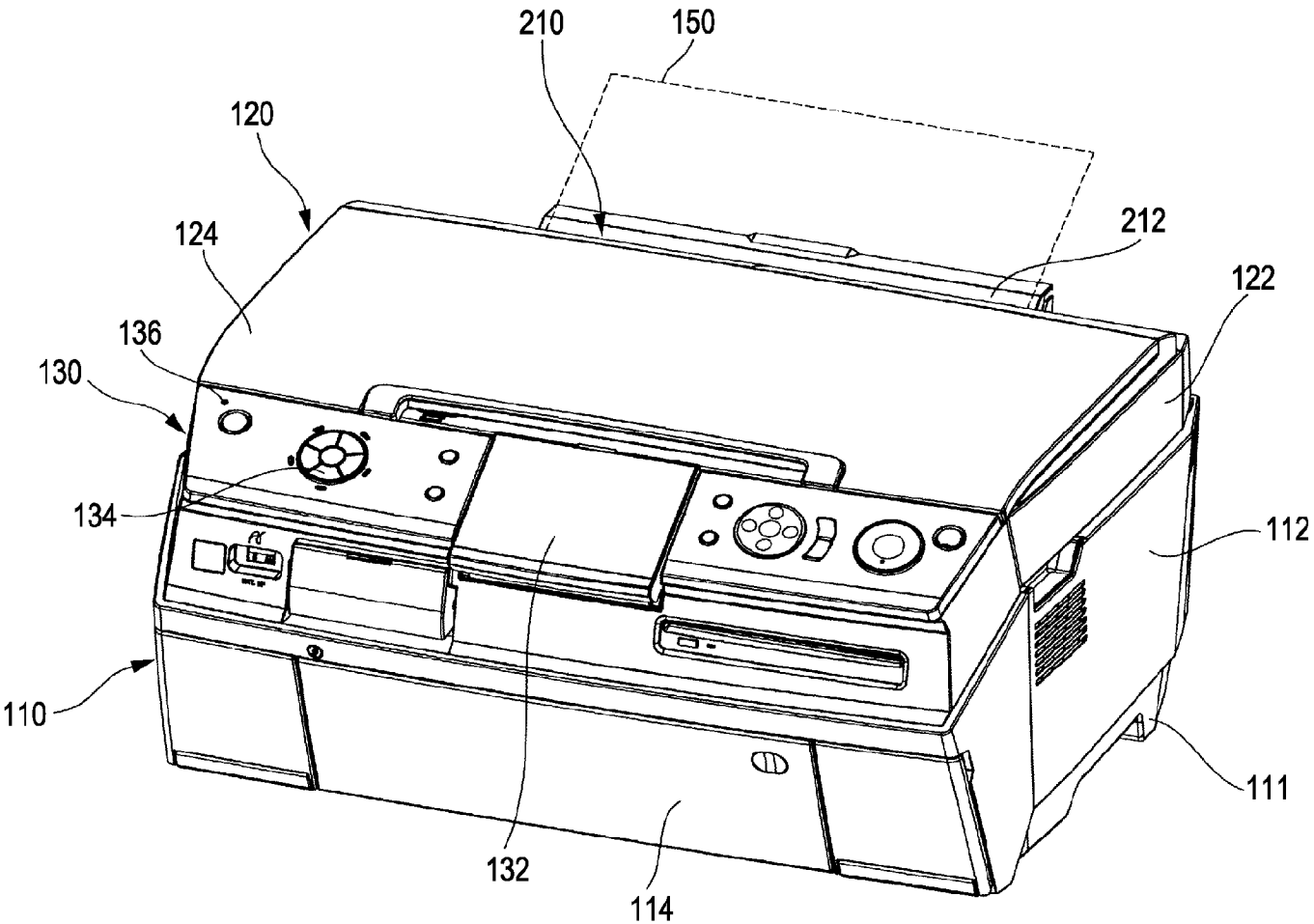
FIG. 1 is a perspective view that schematically shows the entire structure of a multi functional printer.

FIG. 1 is a perspective view that shows an appearance of a multi functional printer 100 provided with an ink jet recording apparatus which is an embodiment of the invention. As shown in the drawing, the multi functional printer 100 includes both a recording unit 110 and a reading unit 120 that is overlapped on top of the recording unit 110.

The reading unit 120 is formed in a case, which also serves as an upper case 122 of the entire multi functional printer 100. On the upper surface of the upper case 122, a reading table is arranged to put an original document that will be read, and an upper cover 124, which also serves as an original copy holder, is further provided to hold an original copy that is put on the reading table.

On the other hand, the recording unit 110 is formed on a case bottom 111 within a case, which also serves as a lower case 112 of the entire multi functional printer 100. In the drawing, a paper support 212 of a feeding unit 210, which will be described later, is shown behind the upper case 122. In addition, on the front face of the lower case 112, a front cover 114 that installs a discharge tray 248 of a discharge unit 240, which will be described later, on the rear face is closed.

Furthermore, the multi functional printer 100 is provided with an operation panel 130 on the front side to the upper cover 124. The operation panel 130 is provided with a plurality of operation buttons 134, a pilot lamp 136, and the like, in addition to a display panel 132. When the multi functional printer 100 is operated in a stand-alone manner, various commands may be input or operating states, and the like, may be displayed.

In the above described multi functional printer 100, the image of an original copy, which is mounted on the reading unit 120 by opening the upper cover 124, will be read from the lower side. In addition, a sheet of recording paper 150 that is set on the paper support 212 is transported through the inside of the recording unit 110 toward the front and an image is recorded on the way by means of an internal mechanism 200, which will be described later.

Figure 2:
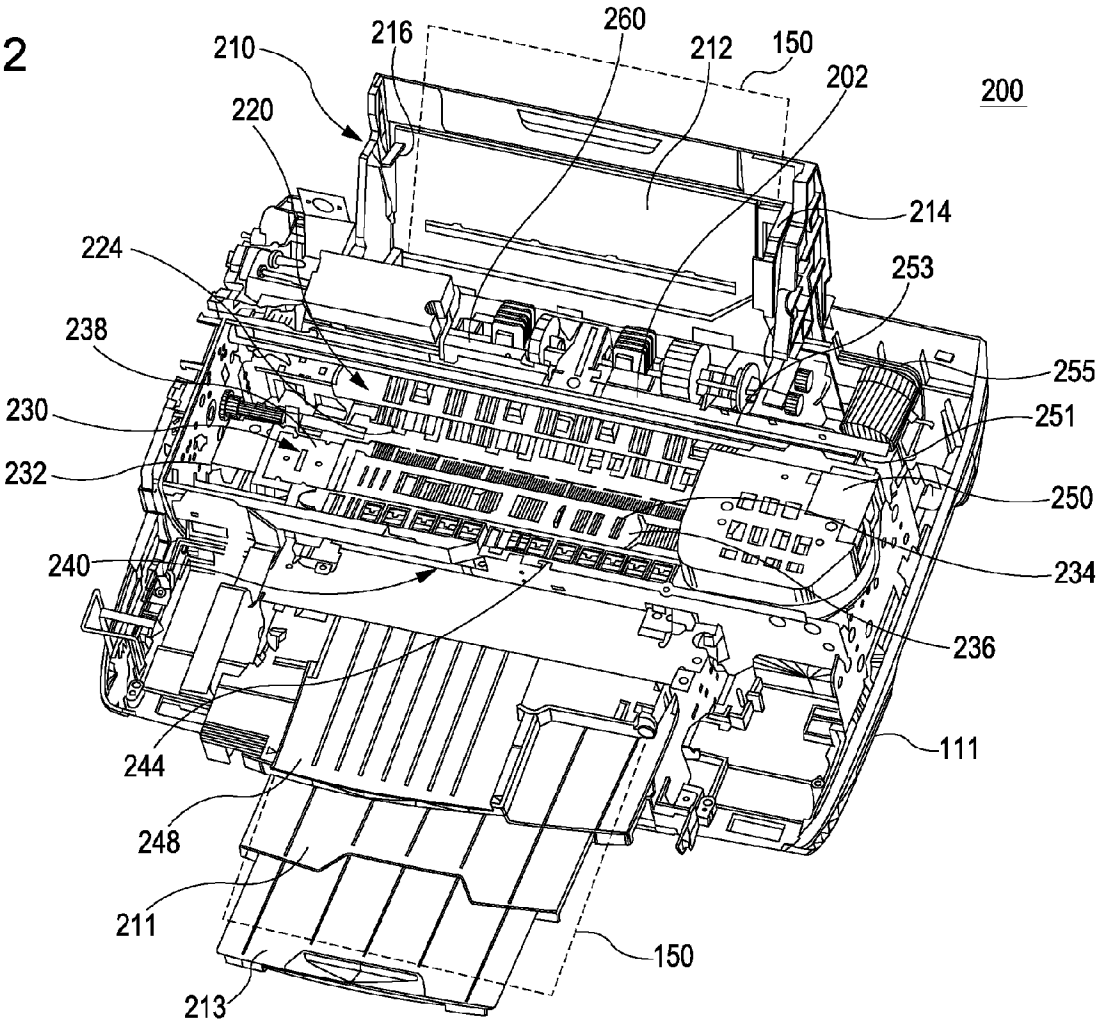
FIG. 2 is a perspective view that specifically shows an internal mechanism of a recording unit.
Figure 3:
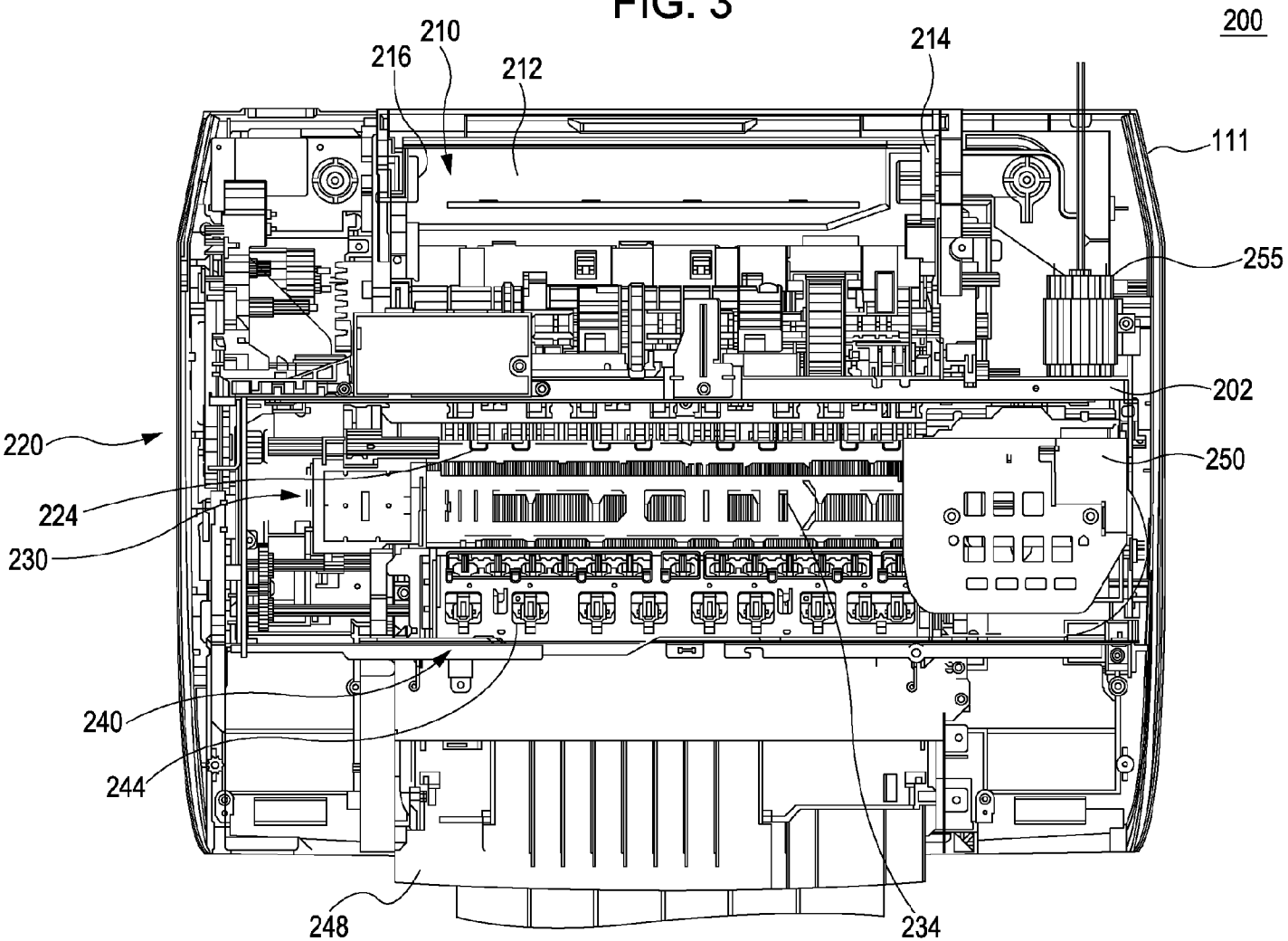
FIG. 3 is a plan view that shows the structure of the internal mechanism as viewed from above.

FIG. 2 is a perspective view that specifically shows the internal mechanism 200 of the recording unit 110 of the multi functional printer 100 shown in FIG. 1. FIG. 3 is a plan view that shows the structure of the internal mechanism 200 as viewed from above. As shown in the drawings, the internal mechanism 200 includes a case bottom 111, a frame 202, the feeding unit 210, a transport unit 220, the platen 230 and the discharge unit 240. The frame 202 extends vertically from the case bottom 111. The feeding unit 210 is arranged behind the frame 202. The transport unit 220, the platen 230 and the discharge unit 240 are serially arranged in front of the frame 202.

The feeding unit 210 includes the paper support 212, a side support 214 and a slide support 216. The paper support 212 supports the rear face of the sheet of recording paper 150 that is set vertically. The side support 214 positions the side end portion of the sheet of recording paper 150, which is shown to the right side of the figures. The slide support 216 prevents the sheet of recording paper 150 from inclining in such a manner that the slide support 216 contacts the side end portion of the sheet of recording paper 150, which is shown to the left side of the figures. The slide support 216 is movable horizontally on the front face of the paper support 212. When the sheet of recording paper 150 having a different width is set, the slide support 216 may be moved to contact the side end portion of the sheet of recording paper 150. The feeding unit 210 further includes a feeding roller 218, and the like, that are hidden by the frame 202. The feeding roller 218, and the like, when the recording unit 110 operates recording, draws a plurality of the sheets of recording paper 150 that are set on the paper support 212 into the internal mechanism 200 sheet by sheet.

Note that the internal mechanism 200 also includes a horizontal paper support 211 that is arranged below a discharge tray 248, which will be described later, and has an opening at the front face. The paper support 211 supports sheets of recording paper 150, which are set horizontally from the front side of the internal mechanism 200, from the lower side. In addition, the sheets of recording paper 150 that are set on the paper support 211 may also be sent to the transport unit 220 using the feeding unit 210. Note that the paper support 211 includes an extension portion 213 and is able to support a sheet of recording paper 150 having a length longer than the depth of the paper support 211 itself.

The transport unit 220 is arranged immediately before the frame 202. The transport unit 220 includes a transporting driven roller 224 that contacts the upper face of the drawn sheet of recording paper 150 and is rotated by the movement of the sheet of recording paper 150. A transporting drive roller is arranged just below the transporting driven roller 224 and is driven by a transporting motor (not shown) for rotation. Thus, the sheet of recording paper 150 that has been drawn into the internal mechanism 200 is pressed against the transporting drive roller by the transporting driven roller 224 and sent onto the platen 230 in accordance with the rotation of the transporting drive roller.

The platen 230 includes a plurality of ribs 234 that extend upward. The ribs 234 contact the lower face of the sheet of recording paper 150 being sent at the distal ends thereof to position the sheet of recording paper 150 in a vertical direction. The sheet of recording paper 150 that has passed the upper side of the platen 230 finally arrives at the discharge unit 240. Note that the structure of the platen 230 will be specifically described separately with reference to FIG. 4.

The discharge unit 240 is arranged to the front side of the platen 230. The discharge unit 240 includes a discharge driven roller 244 that contacts the upper face of the sheet of recording paper 150, which has been sent through the upper side of the platen 230, and is rotated in accordance with the movement of the sheet of recording paper 150. A discharge drive roller is arranged just below the discharge driven roller 244 and is driven by the transporting motor for rotation through a rotation transmitting mechanism (not shown). The sheet of recording paper 150 is pressed against the transporting drive roller by the discharge driven roller 244 and is sent to the front side of the recording unit 110 in accordance with the rotation of the discharge drive roller. The discharge tray 248 is arranged to the front side of the discharge unit 240. The sheets of recording paper 150 that have been discharged outside the recording unit 110 will be stacked on the discharge tray 248.

Furthermore, the internal mechanism 200 includes a carriage 250 that reciprocally moves above the platen 230. That is, the carriage 250 is mounted so that it is movable horizontally in the longitudinal direction of the frame 202 along a guide member (not shown) that is provided on the front face of the frame 202 and extends in the longitudinal direction of the frame 202. In addition, a timing belt 253 is arranged to the front face of the frame 202 and is wound around a pair of pulleys 251. Furthermore, the carriage 250 is connected to the timing belt 253 at the rear face thereof.

In the meantime, because one of the pulleys 251 is driven by the carriage motor 255 for rotation, the carriage 250 moves in accordance with the displacement of the timing belt 253. Thus, by controlling the operation and rotating direction of the carriage motor 255, it is possible to move the carriage 250 to the upper side of an arbitrary region on the platen 230. Furthermore, the carriage 250 includes a recording head (not shown), which includes a nozzle plate 252, at the lower face thereof. Thus, the carriage 250 is able to discharge ink toward an arbitrary region on the platen 230.

In the multi functional printer 100 provided with the internal mechanism 200 having the above described structure, the sheets of recording paper 150 that are set on the front paper support 211 or the rear paper support 212 are drawn by the feeding unit 210 into the transport unit 220 sheet by sheet. The sheet of recording paper 150 that has been drawn to the transport unit 220 passes the upper side of the platen 230 and then reaches the discharge unit 240. The sheet of recording paper 150 is finally sent by the discharge unit 240 outside the internal mechanism 200.

In addition, when the sheet of recording paper 150 is present above the platen 230, the carriage 250 discharges ink downward while reciprocally moving above the platen 230. Thus, it is possible to discharge ink and adhere the ink to an arbitrary region on the surface of the sheet of recording paper 150. Further, the sheet of recording paper 150 is transported intermittently line by line, while the carriage 250 is reciprocally moved during the transportation is interrupted. Thus, an image may be recorded over the entire surface of the sheet of recording paper 150.

Note that a control unit 260 is mounted behind the frame 202 and controls a series of recording operations as described above. The control unit 260 controls the recording unit 110 to operate appropriately on the basis of commands input through an information processing device, or the like, which is connected to the multi functional printer 100, or commands input through the operation panel 130. In addition, the control unit 260 is also an interface that receives image information that will be recorded by the recording unit 110. The image information received by the control unit 260 may include, in addition to the information that indicates resolution of a recording image, a recording quality such as the number of colors, recording object information such as size and material.

Figure 4:
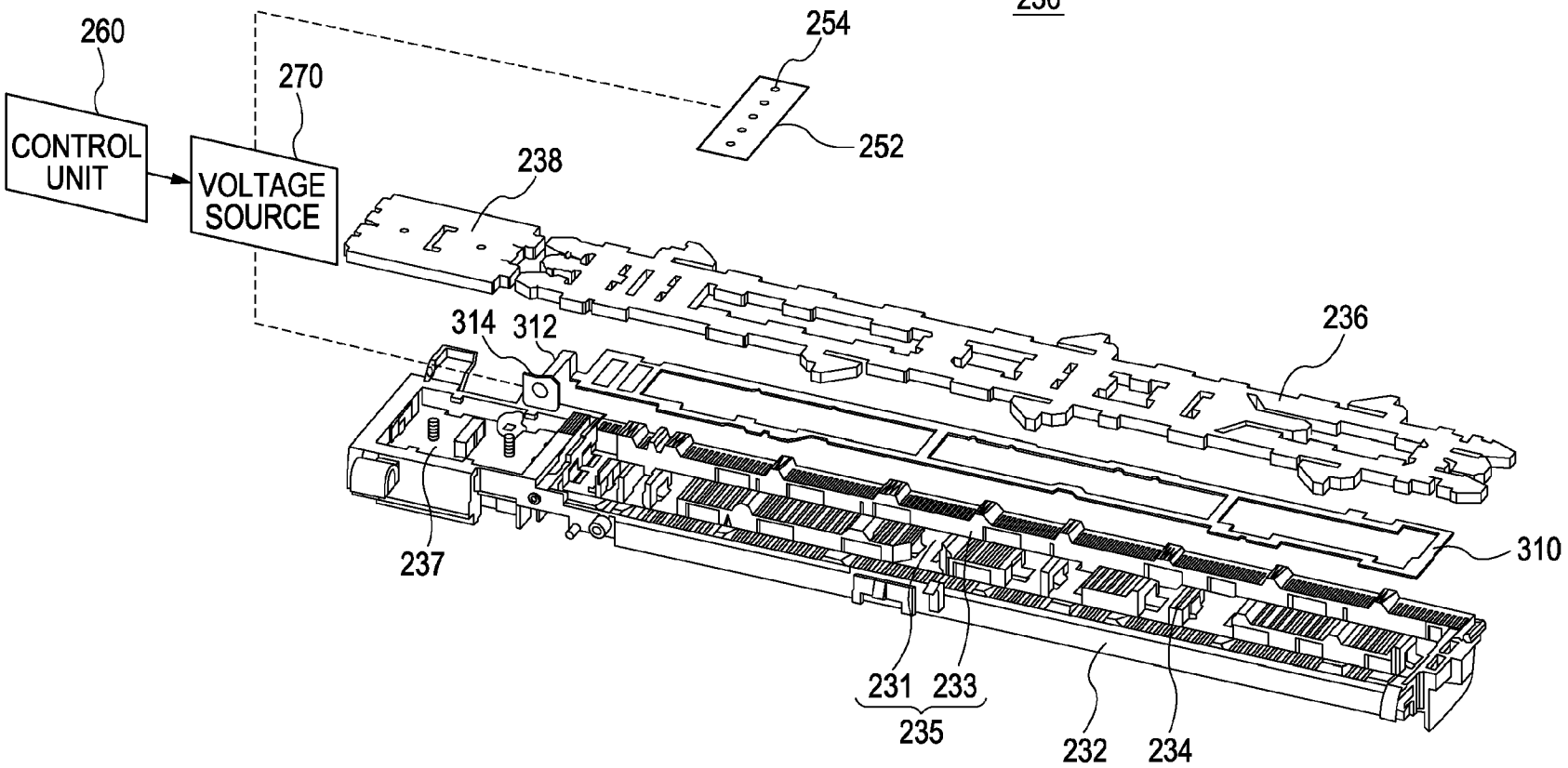
FIG. 4 is an exploded perspective view that shows the structure of a platen alone.

FIG. 4 is an exploded perspective view that specifically shows the structure of the platen 230 in the internal mechanism 200. As shown in the drawing, the platen 230 includes a platen body 232, an electrode 310 and absorption members 236, 238. The electrode 310 is accommodated in the platen body 232.

The platen body 232 is integrally formed from a resin material to include the plurality of ribs 234, an accommodation portion 235 and an accommodation portion 237. The plurality of ribs 234 extend upward from the upper face of the platen body 232. The accommodation portion 235 having a larger width is depressed from the upper face of the platen body 232 and formed to include a bottom portion 231 and a side wall portion 233. The accommodation portion 237 having a smaller width is formed to the side of a region in which the ribs 234 are formed. When the sheet of recording paper 150 passes above the platen 230, the upper ends of the ribs 234 contact the lower face (rear face) of the sheet of recording paper 150 to position the sheet of recording paper 150 in the vertical direction.

In addition, the absorption members 236, 238 have a size to fill the inside of the platen bodies 232, 237. Further, the absorption members 236, 238 are formed of a material that is selected by laying emphasis on absorption velocity of the surfaces thereof with respect to liquid. For this reason, the amount of ink that the absorption members 236, 238 can hold is limited. Then, a waste liquid absorption member, which has a larger capacity than these absorption members 236, 238, may be additionally arranged below the platen 230.

The platen 230 further includes the electrode 310 below the absorption member 236 inside the wider accommodation portion 235. The electrode 310 is arranged to substantially cover the bottom portion 231 of the accommodation portion 235. Further, a connecting portion 312 and a terminal portion 314 are integrally formed at one end of the electrode 310. The connecting portion 312 extends outward over the side wall portion 233 of the accommodation portion 235. The terminal portion 314 is exposed to the outside of the platen 230. When the electrode 310 is connected through the terminal portion 314 to one end of a voltage source 270, which operates under the control of the control unit 260, it is possible to apply voltage to the electrode 310. The other end of the voltage source 270 is connected to the nozzle plate 252, which is mounted on the carriage 250. Thus, it is possible to generate a difference in potential between the nozzle plate 252 and the electrode 310 to form an electric field.

The material of the absorption members 236, 238 may preferably include a material that is made by foaming a resin material, such as polystylene or polyurethane. In addition, for the purpose of applying the same potential to the absorption member 236 as that of the electrode 310, it is preferable that the absorption member 236 is formed of a conductive material that will have a surface resistance of 108Ω or below. Such a material may be a material that is formed by foaming a resin, such as polyethylene or polyurethane, that has been mixed with a conductive material, such as metal or carbon or a material in which a conductive material, such as metal or carbon, is adhered or plated onto a foamed resin made from a material, such as polyethylene or polyurethane. In addition, it may also be used as the material that electrolytic solution is impregnated into a foamed resin made from a material, such as polyethylene or polyurethane.

On the other hand, the material of the electrode 310 may include a metal that is anticorrosive to ink, such as a wire, a plate or a foil that is made of gold, stainless, or nickel; a wire, a plate or a foil that is plated with these metals; or a mesh or a grid like member that combines some of these materials. Moreover, according to another embodiment, a conductive coating film layer, a plating layer, a thick film layer, a thin film layer, or the like, which is directly formed on the bottom portion 231 of the accommodation portion 235 of the platen 230, may also be used as the electrode 310.

Figure 5:
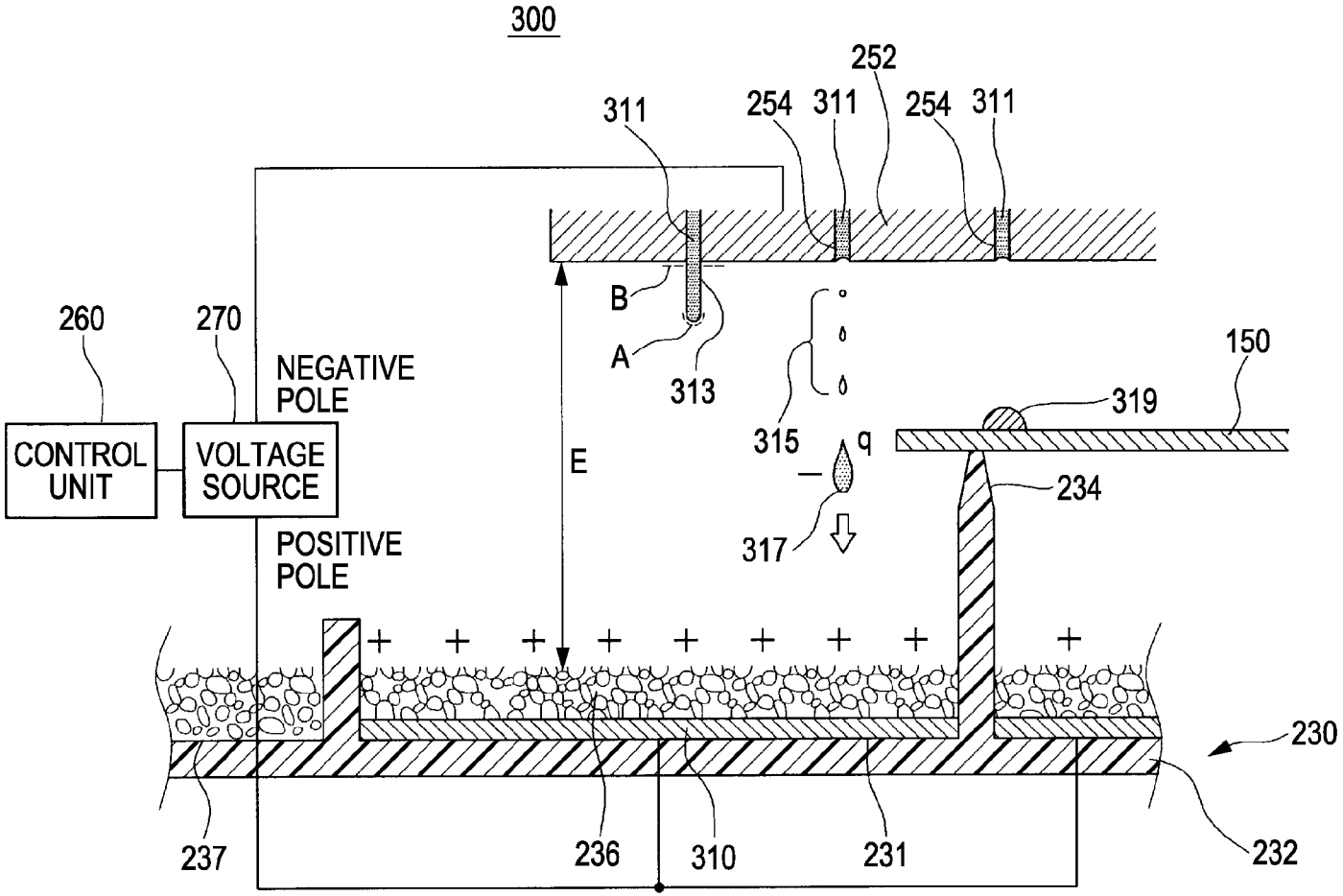
FIG. 5 is a conceptional view that illustrates operation of an aerosol collecting mechanism.

FIG. 5 is a schematic view that illustrates the structure and operation of an aerosol collecting mechanism 300 formed in the internal mechanism 200 of the recording unit 100. As shown in the drawing, the nozzle plate 252 that has openings 254 for discharging ink is, for example, made of metal and has a conductivity. Moreover, the nozzle plate 252 is connected to the negative electrode of the voltage source 270. On the other hand, the positive electrode of the voltage source 270 is connected to the electrode 310 that is accommodated in the platen 230. Further, the absorption member 236, which is stacked on the electrode 310 and accommodated in the platen 230, has a conductivity, so that the entire absorption member 236 is applied with the same potential as that of the electrode 310. Thus, an electric field E caused by a difference in potential generated by the voltage source 270 is uniformly formed between the lower face of the nozzle plate 252 and the surface of the absorption member 236. Note that, even when all the polarities may be inverted and connected, the same function may be achieved.

During recording operation, the nozzle plate 252 discharges ink 311 through the openings 254 downward. Here, when the sheet of recording paper 150 is present just below the openings 254, the discharged ink 311 is adhered onto the upper face of the sheet of recording paper 150 to form an image 319. On the other hand, when the ink 311 is intended to be adhered to the peripheral portion of the sheet of recording paper 150 without any margin, there is a possibility that the sheet of recording paper 150 is not present just below a portion of the openings 254 around the side periphery, front end and rear end of the sheet of recording paper 150.

In this case, kinetic energy given to ink droplets 317 that are generated through the discharge from the openings 254 is rapidly lost due to the viscous drag of the atmosphere. For this reason, portions of the ink droplets 317 lose their kinetic energy far before they reach the conductive absorption member 236. Since the weight of each ink droplet 317 is extremely small, when the ink droplet 317 loses its kinetic energy, the following falling velocity becomes extremely small because falling motion due to gravitational acceleration becomes substantially equal to a viscous drag force of the atmosphere. In this way, aerosols that float below the nozzle plate 252 are produced. In addition, part of the ink droplet 317 may be split to become further fine ink droplets, that is, satellite inks 315, this also becomes aerosols.

However, in the aerosol collecting mechanism 300, as is already described above, the electric field E is formed between the surface of the absorption member 236 and the lower face of the nozzle plate 252. Thus, the ink droplet 317 having an electric charge q gains kinetic energy owing to Coulomb force Fe (qE) that is received from the electric field E and moves downward without any deceleration to reach the absorption member 236.

Note that the inks 311 that are pushed out from the openings 254 each form an ink column 313 that hangs down from the nozzle plate 252 at the moment immediately before each ink 311 leaves from the nozzle plate 252 to become the ink droplet 317. At this time, an electric charge is stored between a distal end A of the ink column 313 and a region B around the ink column 313 on the lower face of the nozzle plate 252 due to a so-called lightning rod effect. Due to this lightning rod effect, each of the ink droplets 317 is charged with an electric charge q that is larger than an electric charge corresponding to a horizontal cross-sectional area of the ink column 313. Note that the lightning rod effect means a phenomenon that the region B on the surface of the nozzle plate 252, surrounded by a conical shape which has a vertex positioned at the distal end A (lower end in the drawing) of the ink column 313 and a vertical angle of 50 degrees to 60 degrees, contributes to charging of the ink droplet 317. Thus, each of the ink droplets 317 receives a relatively large Coulomb force and flies in the electric field E to the absorption member 236 without losing its kinetic energy.

Figure 6:
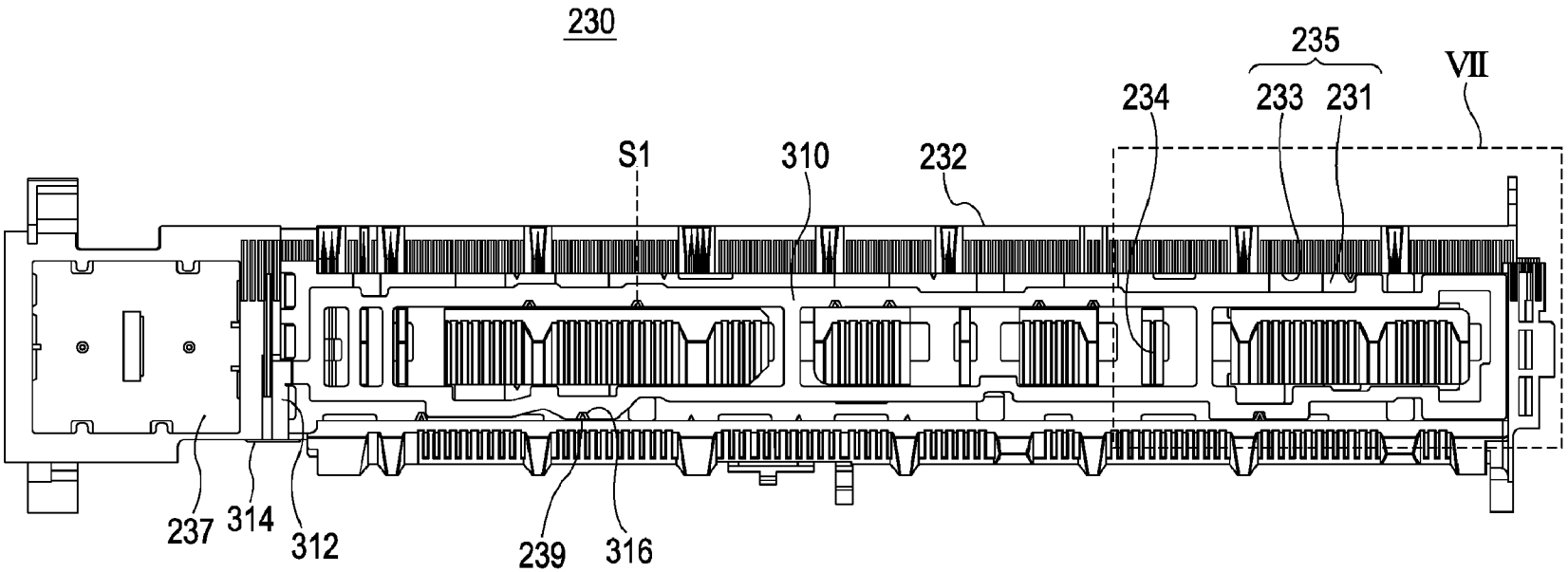
FIG. 6 is a plan view that shows a process of assembling an electrode to a platen body.

FIG. 6 is one of figures that show the attaching structure of the electrode 310 in the platen 230 using the procedure of attaching the electrode 310. As shown in the drawing, the electrode 310 that is shown to the upper side of the platen body 232 in FIG. 4 is accommodated in the bottom portion 231 of the accommodation portion 235 that is formed in the platen 230. In addition, the electrode 310 has a plate-like shape that follows the shape of the bottom portion 231.

However, the electrode 310 is not fixed in a state shown in FIG. 6. That is, a plurality of engaging pawls 239 are formed on the side wall portion 233 of the accommodation portion 235 so as to extend inward of the accommodation portion 235. On the other hand, cutout portions 316 are formed at the periphery of the electrode 310 and located at positions corresponding to the engaging pawls 239.

Figure 7:
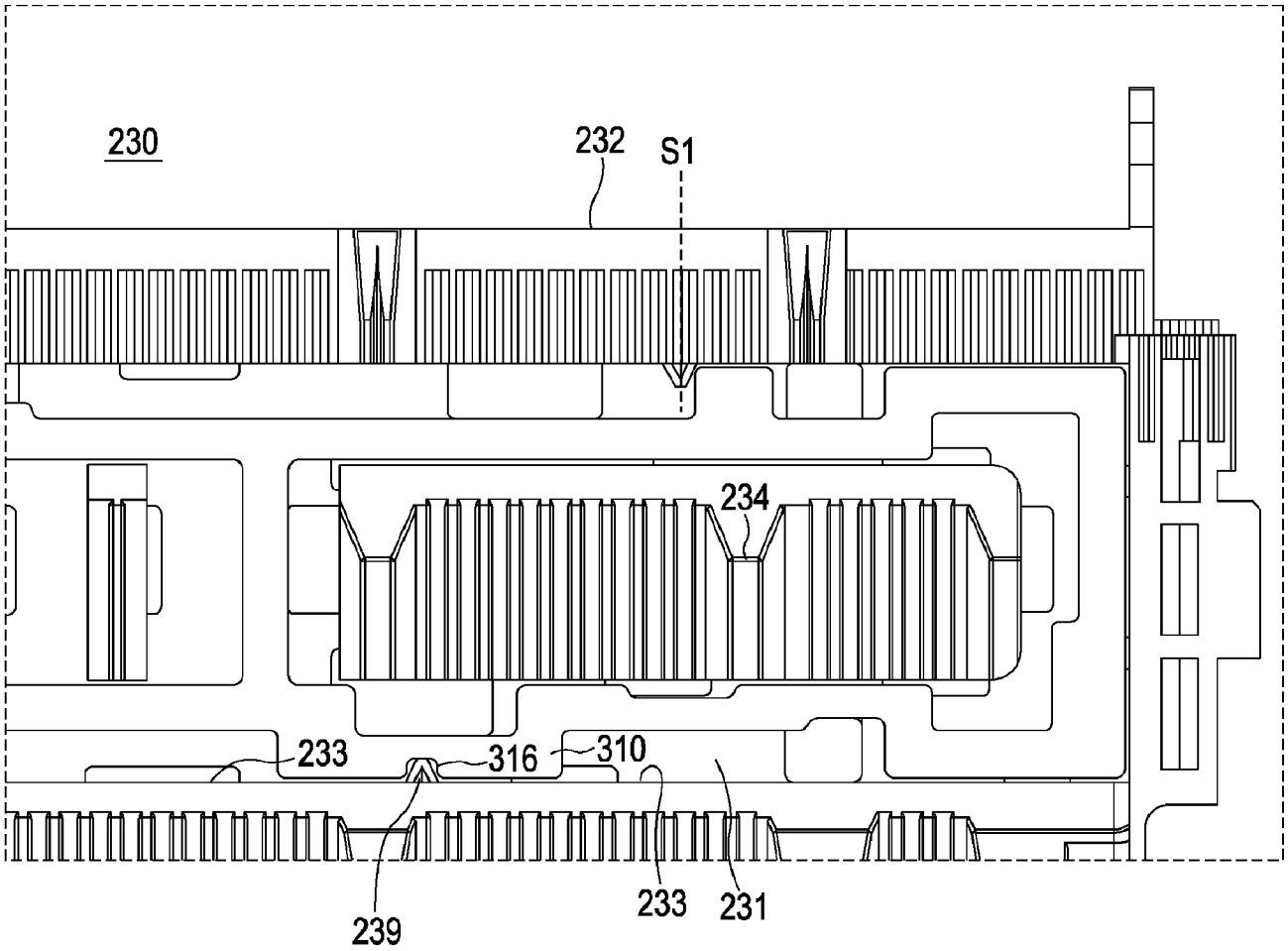
FIG. 7 is a partially enlarged view of the platen body shown in FIG. 6.

FIG. 7 is a partially enlarged view that shows a state just after the engaging pawl 239 is passed through the cutout portion 316. FIG. 7 corresponds to a portion surrounded by dotted line VII shown in FIG. 6. As shown in the drawing, the planar shape of the cutout portion 316 is larger in area than the planar shape of the engaging pawl 239. Thus, by passing the engaging pawl 239 through the cutout portion 316, it is possible to easily insert the electrode 310 into the accommodation portion 235 to such an extent that the electrode 310 contacts the bottom portion 231.

Figure 8:
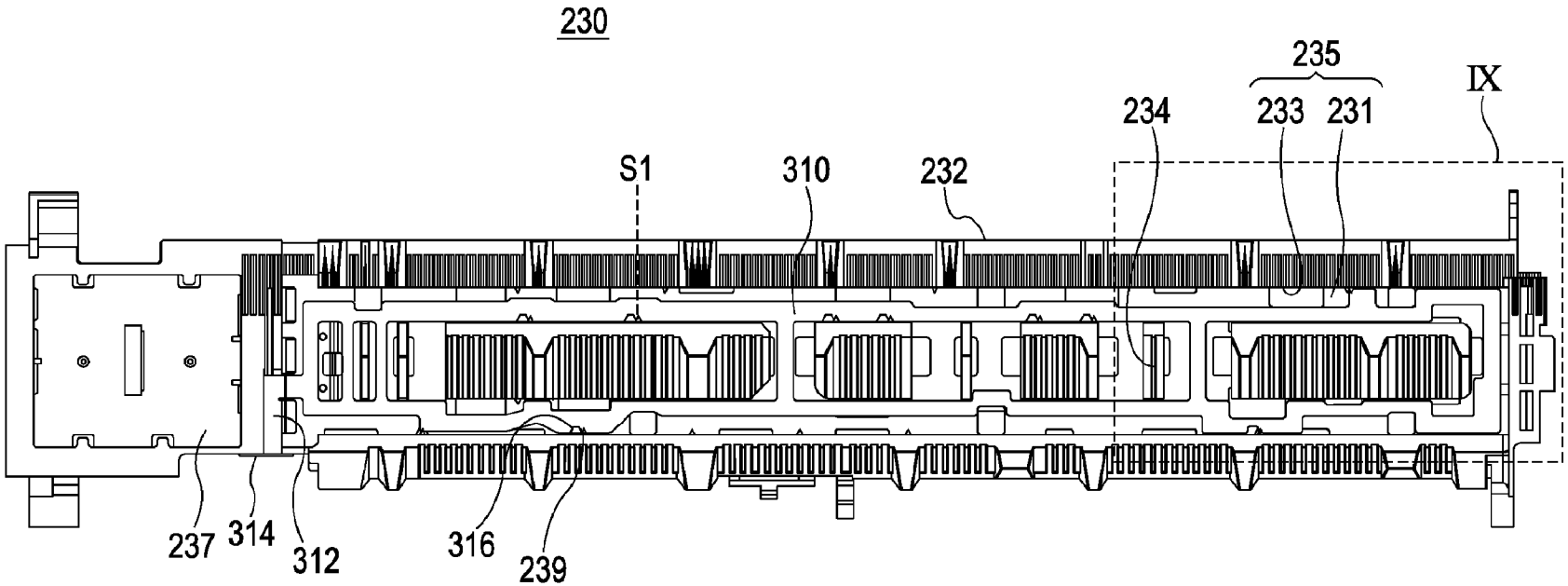
FIG. 8 is a plan view that shows the next process of assembling the electrode to the platen body.

FIG. 8 is a plan view that shows the next process of assembling the electrode 310 to the platen body 232. As shown in the drawing, in comparison with the state shown in FIG. 6, the electrode 310 is displaced to the left side in the drawing.

Figure 9:
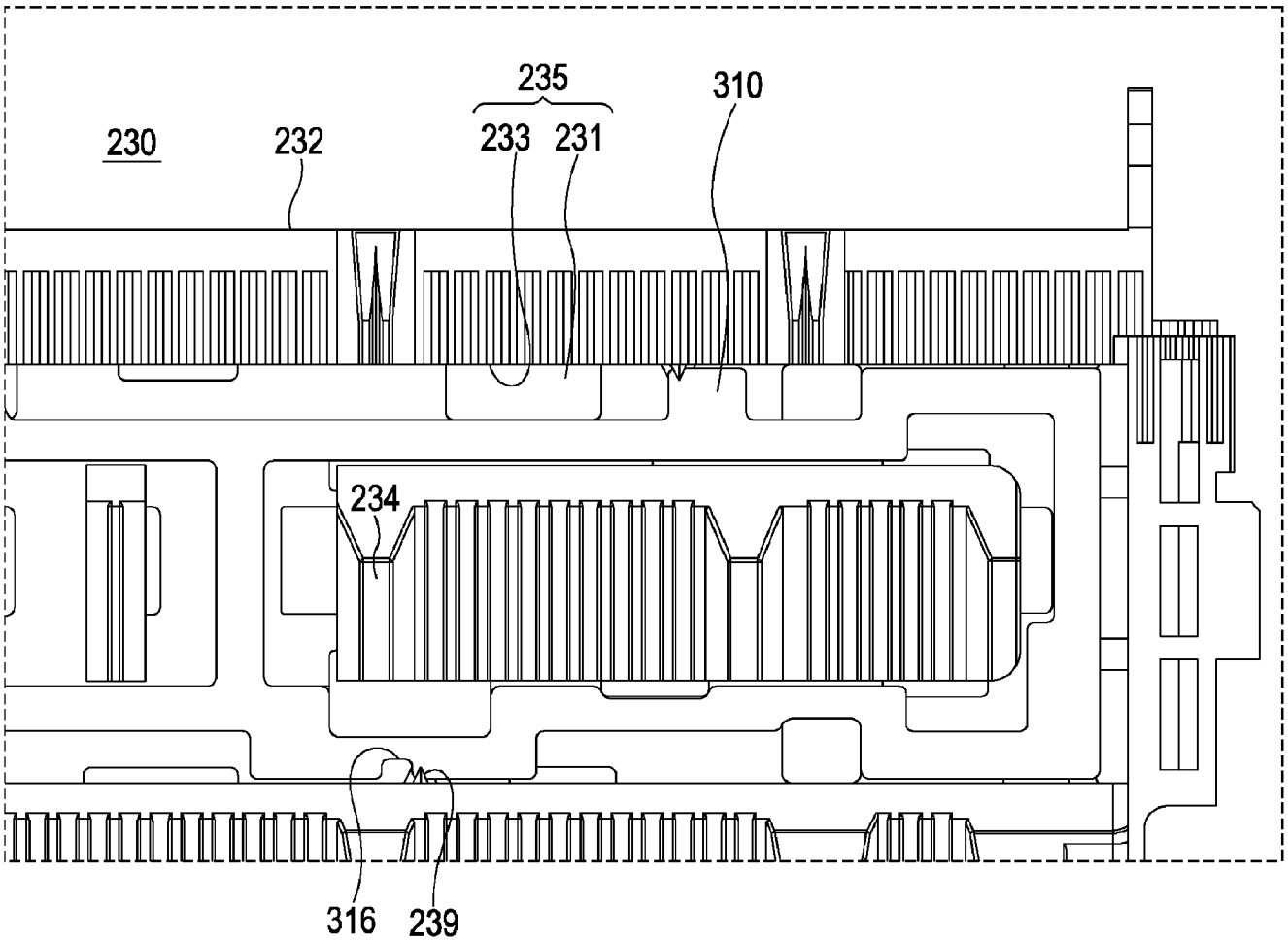
FIG. 9 is a partially enlarged view of the platen body shown in FIG. 8.

FIG. 9 is a partially enlarged view of the platen body 232 shown in FIG. 8. FIG. 9 shows a region surrounded by dotted line IX in FIG. 8. As shown in the drawing, because the cutout portion 316 is displaced in accordance with the movement of the electrode 310, the engaging pawl 239 adjacent to the platen body 232 is positioned outside the cutout portion 316.

Figure 10:
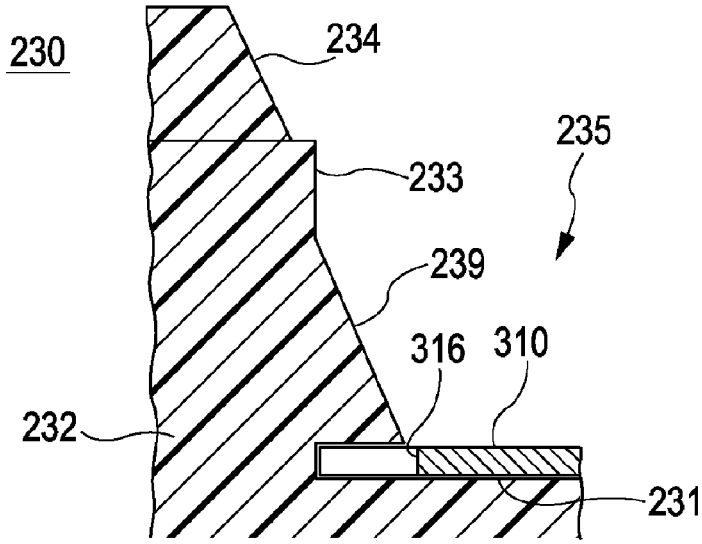
FIG. 10 is a cross-sectional view that shows the positional relationship between an engaging pawl and a cutout portion in a state shown in FIG. 6.

FIG. 10 is a cross-sectional view, taken along the dotted line S1 in FIG. 6, that shows the positional relationship between the engaging pawl 239 and the cutout portion 316 in a state shown in FIG. 6. As shown in the drawing, immediately after the electrode 310 has been set into the accommodation portion 235, the electrode 310 is not located just below the engaging pawl 239.

Figure 11:
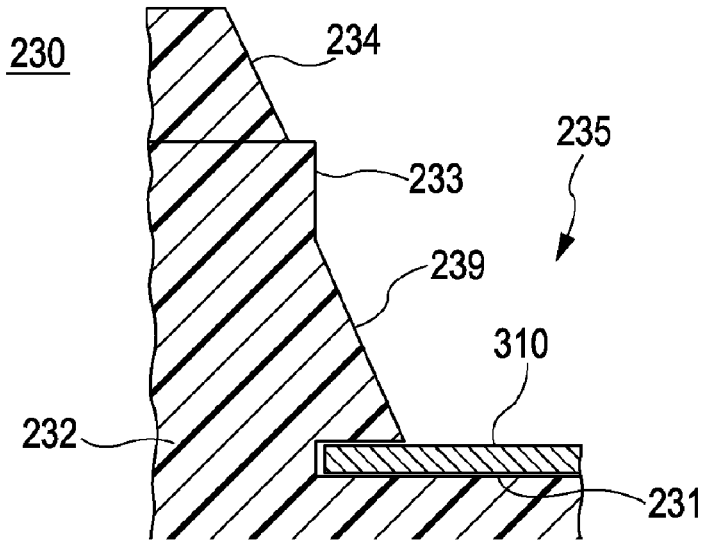
FIG. 11 is a cross-sectional view that shows the positional relationship between an engaging pawl and a cutout portion in a state shown in FIG. 8.

FIG. 11 is a cross-sectional view, taken along the dotted line S1 in FIG. 8, that shows the positional relationship between the engaging pawl 239 and the cutout portion 316 in a state shown in FIG. 8. As shown in the drawing, when the electrode 310 is displaced horizontally from the state shown in FIG. 10, the cutout portion 316 moves to a position that is offset from the position just below the engaging pawl 239. Thus, portion of the upper face of the electrode 310 is located below the engaging pawl 239. For this reason, even when electrostatic force acts on the electrode 310 by applying voltage, upward movement of the electrode 310 is stopped by the engaging pawl 239.

Figure 12:
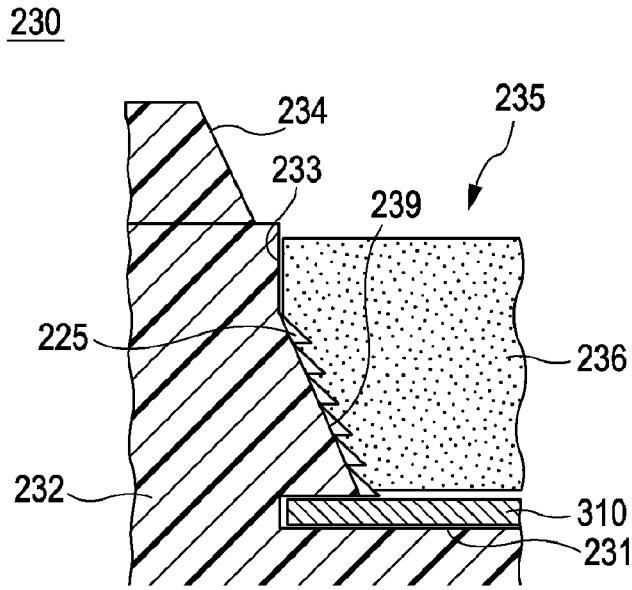
FIG. 12 is a cross-sectional view that shows the shape of the engaging pawl according to an embodiment of the invention.

FIG. 12 is a cross-sectional view that shows the shape of one of the engaging pawls 239 according to an embodiment. The engaging pawl 239 is formed on the side wall face of the accommodation portion 235 in order to prevent the electrode 310 from being lifted, and the surface of the engaging pawl 239 is formed to include side faces that are inclined relative to the side wall portion 233 and extend inward of the accommodation portion. For this reason, because the absorption member 236 is accommodated in the accommodation portion 235 and pressed against the engaging pawl 239, a stress that includes a component to displace the absorption member 236 upward is applied to the absorption member 236. Then, as shown in FIG. 12, a large number of small-sized engaging pawls 225 are formed on the inclined face, so that it is possible to prevent the absorption member 236 to be displaced upward of the absorption member 236.

Figure 13:
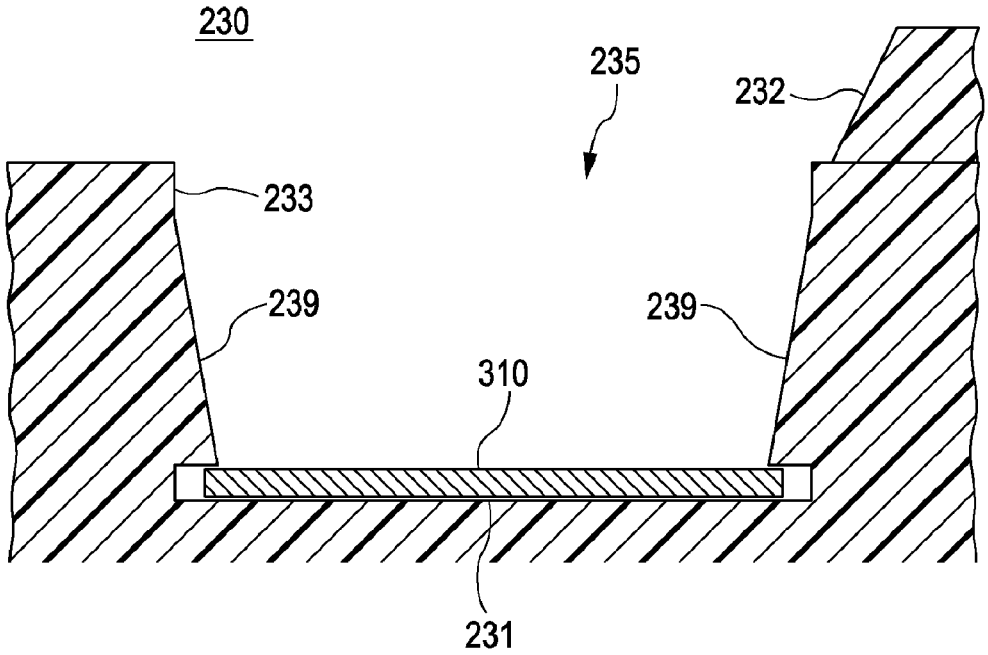
FIG. 13 is a cross-sectional view that shows the shape of the engaging pawls according to another embodiment of the invention.

FIG. 13 is a cross-sectional view that shows the shape of the engaging pawls 239 according to another embodiment. As shown in the drawing, the engaging pawls 239 each extend relatively small from the side wall portion 233 of the accommodation portion 235. Therefore, the side face formed inside the accommodation portion 235 is inclined steeply. The electrode 310 may be set to the engaging pawl 239 having such a shape by pressing from above using elastic deformation of the engaging pawls 239 themselves and elastic deformation of the electrode 310, while the electrode 310, once set, does not move upward but contacts the lower faces of the engaging pawls 239.

Note that, when the platen 230 according to a series of embodiments as described above is supplied as a single piece to replace the platen 230 having the existing electrode, the same advantageous effects may be obtained in the existing liquid ejecting apparatus and the existing recording medium. In addition, in the case of the embodiment shown in FIG. 13, it is possible to assemble the electrode 310, the absorption member 236, or the like, which are removed from the existing platen 230, to the platen body 232, which is supplied as a single piece.

Figure 14:
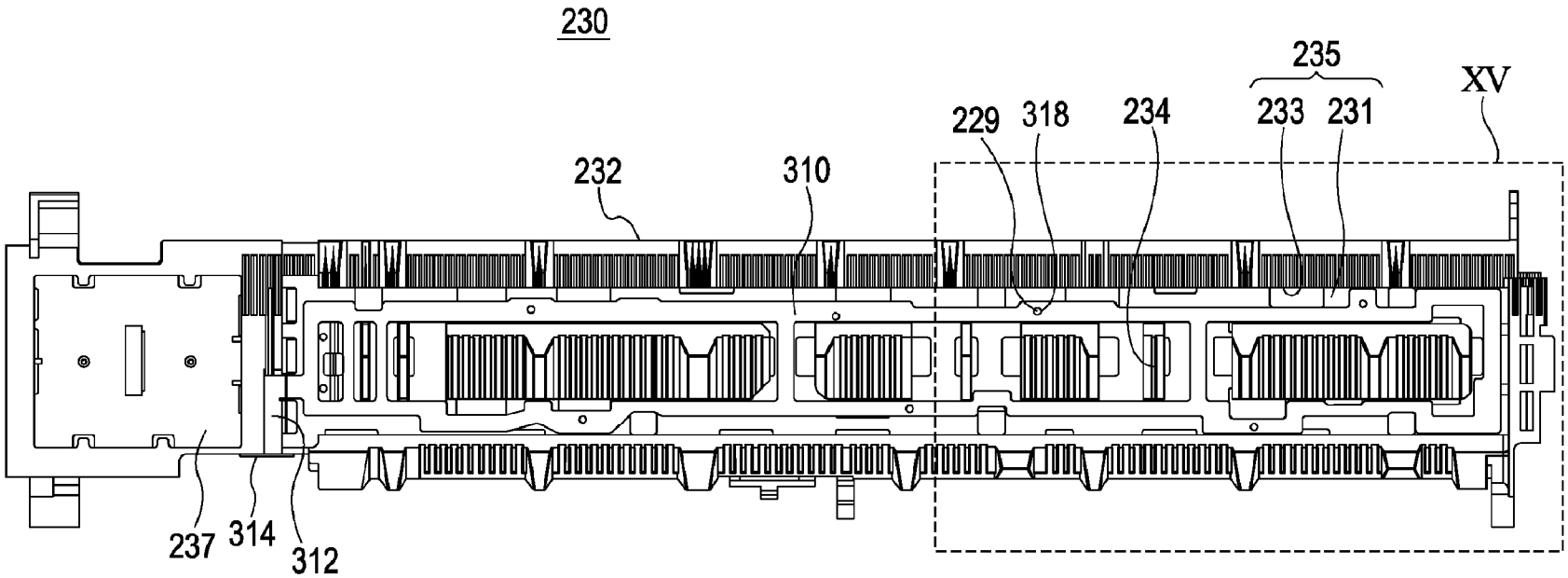
FIG. 14 is a plan view that shows a process of assembling an electrode to a platen body according to yet another embodiment of the invention.

FIG. 14 is a plan view that shows a process of assembling the electrode 310 to the platen body 232 according to yet another embodiment. As shown in the drawing, in this embodiment, a plurality of through-holes 318 are formed in the electrode 310. On the other hand, salients 229, each having a smaller diameter than the inner diameter of the through-hole 318 of the electrode 310, are formed on the bottom portion 231 of the accommodation portion 235 of the platen 230 at positions corresponding to the through-holes 318.

Figure 15:
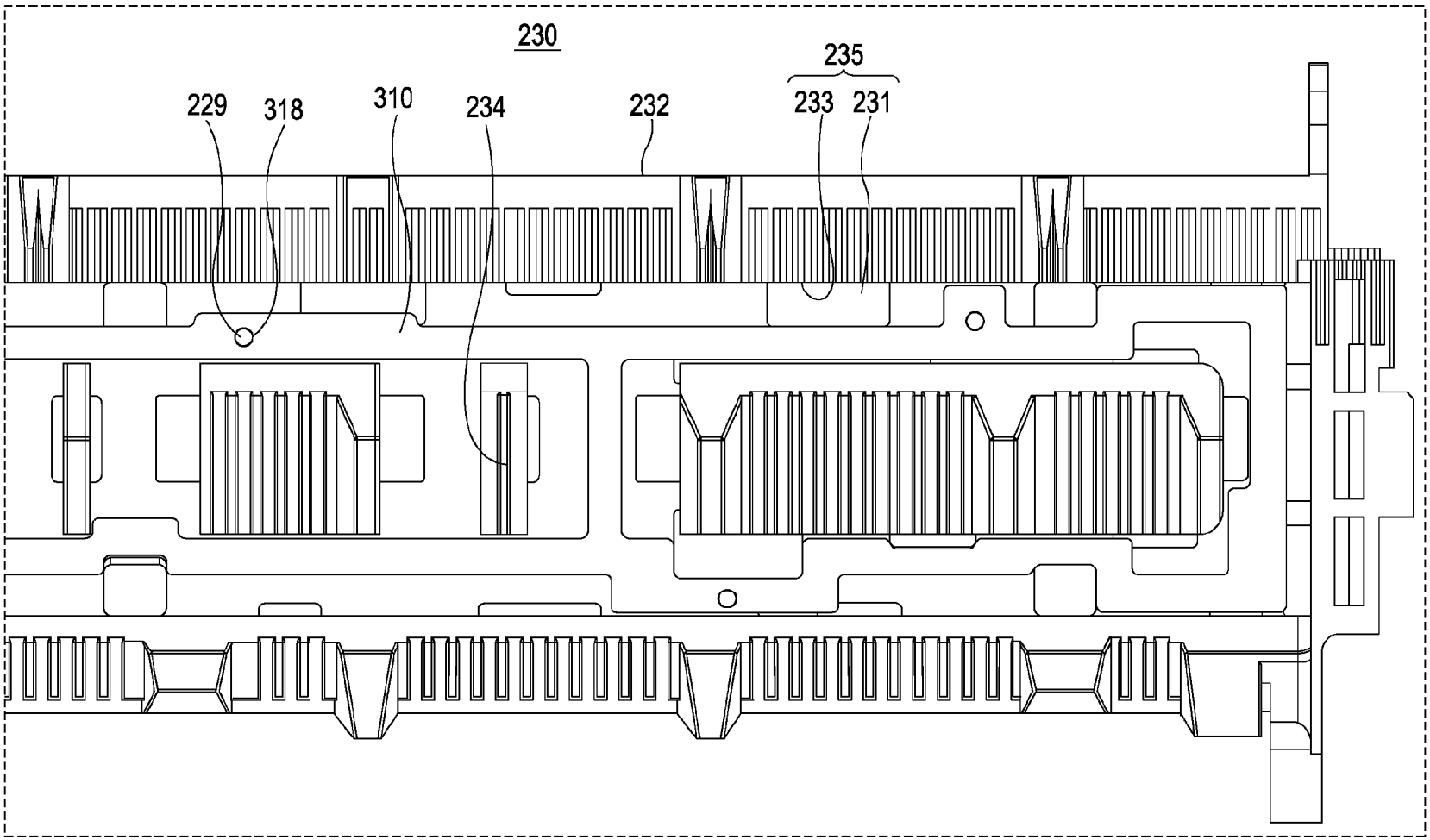
FIG. 15 is a partially enlarged view of the platen body shown in FIG. 14.

FIG. 15 is a partially enlarged view that shows the platen body 232 in a state shown in FIG. 14. FIG. 15 shows a region surrounded by dotted line XV in FIG. 14. As shown in the drawing, by inserting the salients 229 to the corresponding through-holes 318, it is possible to set the electrode 310 so as to contact the bottom portion 231 of the accommodation portion 235.

Figure 16:
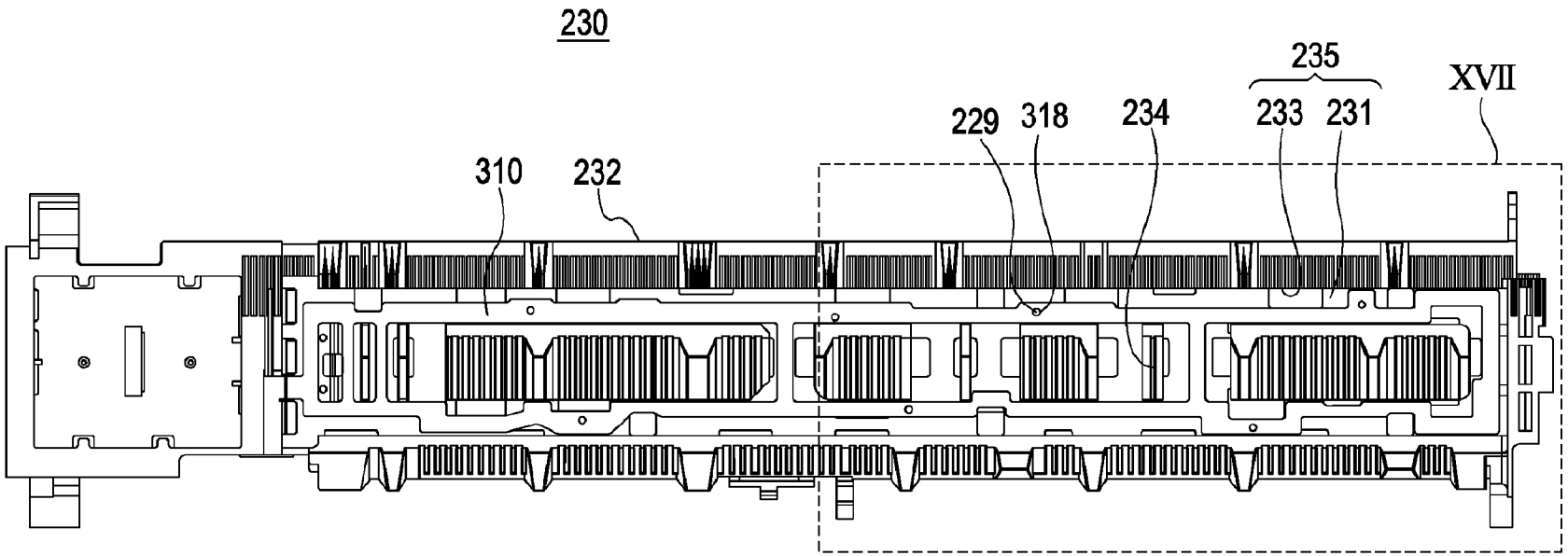
FIG. 16 is a plan view that shows the next process of assembling the electrode to the platen body as viewed in the same direction as that of FIG. 14.

FIG. 16 is a plan view that shows the next process of assembling the electrode 310 to the platen body 232 as viewed in the same direction as that of FIG. 14. As shown in the drawing, in this process, the distal end of each salient 229 is expanded to have a diameter larger than the inner diameter of the through-hole 318. In this manner, the electrode 310 is fixed to the bottom portion 231 of the accommodation portion 235.

Figure 17:
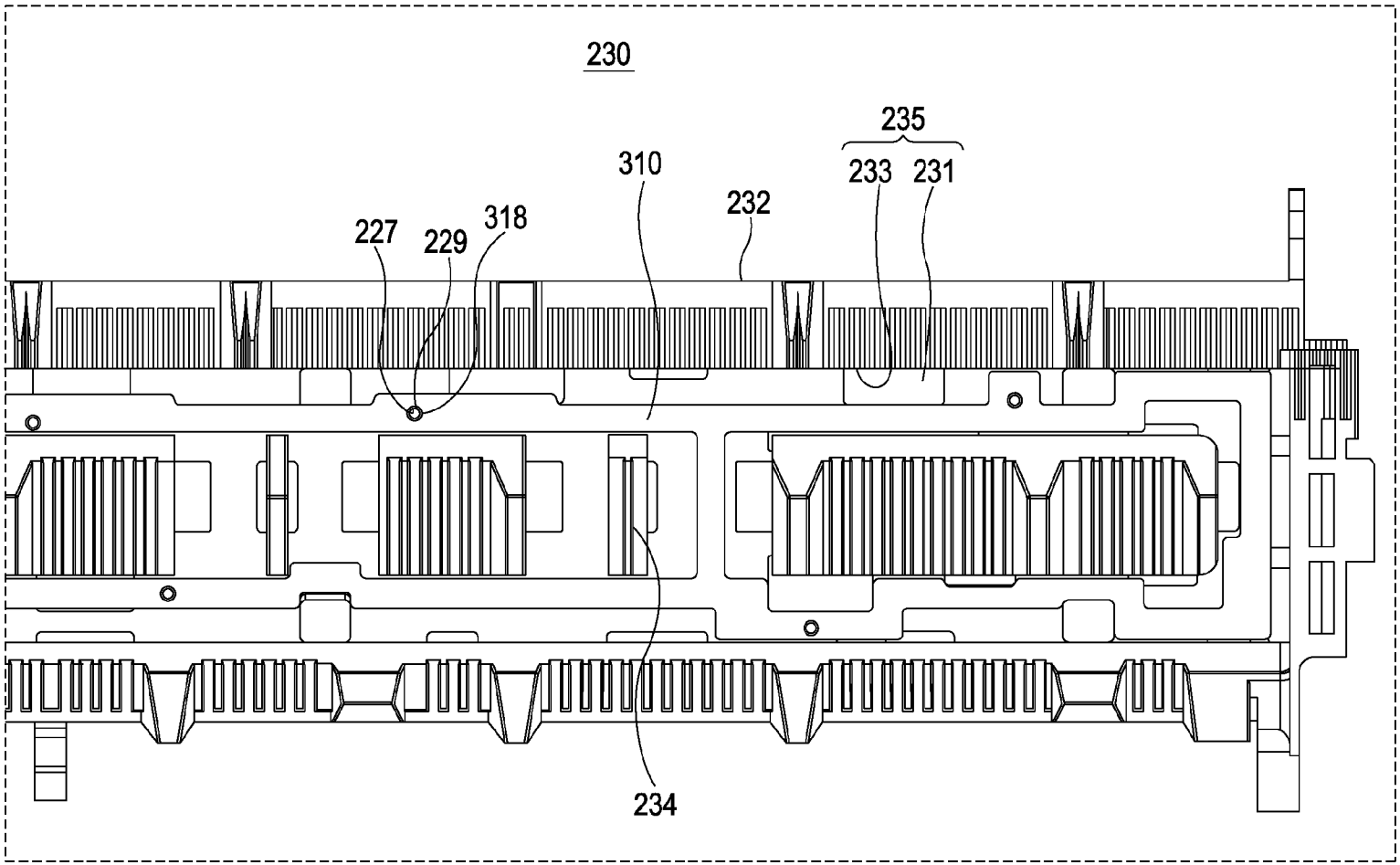
FIG. 17 is a partially enlarged view of the platen body shown in FIG. 16.

FIG. 17 is a partially enlarged view of the platen body 232 shown in FIG. 16. FIG. 17 shows a region surrounded by dotted line XVII in FIG. 16. As shown in the drawing, the distal end of each salient 229 is caulked through a method, which will be described later, and caulked dents 227 are formed as shown in the drawing.

Figure 18:
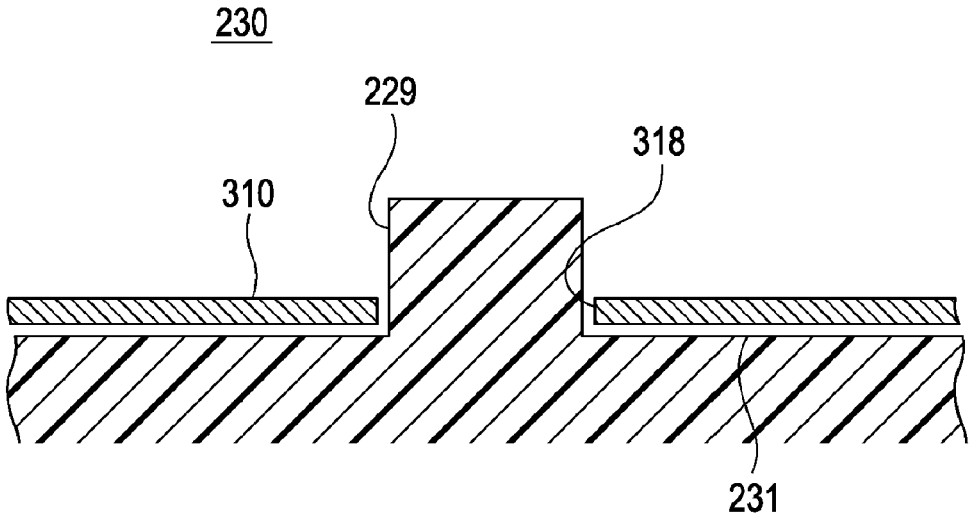
FIG. 18 is a cross-sectional view that shows the positional relationship between a salient and a through-hole in a state shown in FIG. 14 and FIG. 15.

FIG. 18 is a cross-sectional view that shows the positional relationship between the salient 229 and the through-hole 318 in a state shown in FIG. 14 and FIG. 15. As shown in the drawing, each of the salients 229 extends upward from the bottom portion 231 of the accommodation portion 235 is inserted into the corresponding through-hole 318 of the electrode 310 and then extends to the upper side beyond the upper face of the electrode 310.

Figure 19:
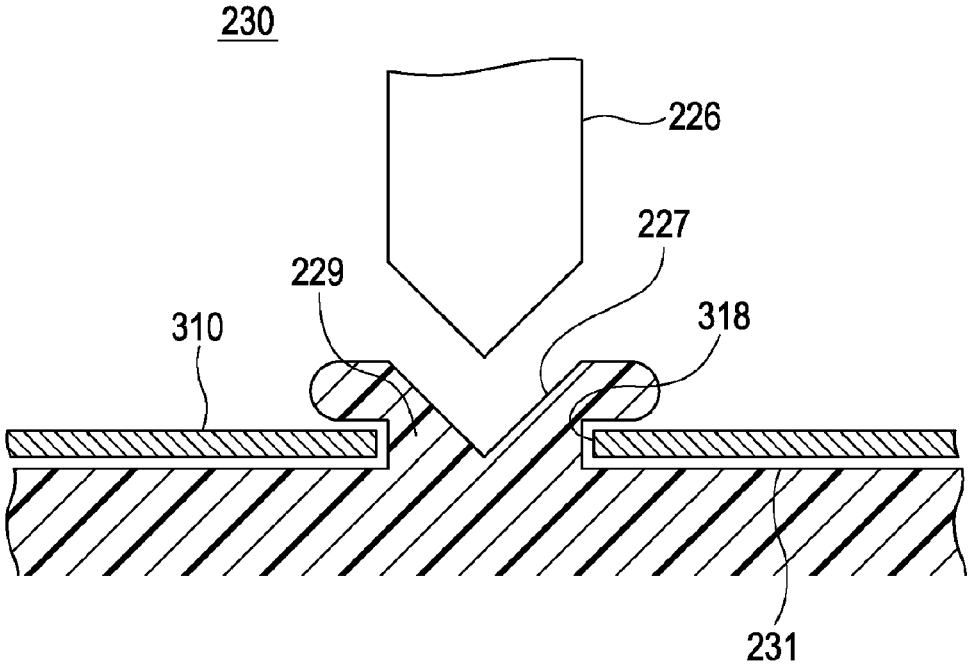
FIG. 19 is a cross-sectional view that shows the shape of the salient and a process of forming the salient in a state shown in FIG. 16 and FIG. 17.

FIG. 19 is a cross-sectional view that shows the shape of each salient 229 and a process of forming the salient 229 in a state shown in FIG. 16 and FIG. 17. As shown in the drawing, by pressing a heating jig 226 against the distal end of the salient 229, the salient 229 is spread out horizontally. In this manner, portion of the salient 229 is expanded to the upper face of the electrode 310 beyond a region of the through-hole 318. Thus, it is possible to prevent the electrode 310 from being displaced upward.

Note that, in the structures shown in FIG. 14 to FIG. 19, because the salients 229 are deformed in a state where the salients 229 are inserted in the through-holes 318, the tolerance of each through-hole 318 and the tolerance of each salient 229 may be set relatively large. Thus, extremely high machining accuracy is not required for manufacturing the electrode 310 and the platen body 232 and, therefore, manufacturing is easy.

In addition, the shape of a retaining portion of the platen body 232 for retaining the electrode 310 is not limited to the above described columnar shape of the salient 229. Furthermore, in the above embodiment, the procedure of assembling the electrode 310 to the platen body 232 is described. However, when the platen body 232 is manufactured, it is possible to initially manufacture the platen body 232 together with the electrode 310 integrally using molding. In this case, it is possible to omit a process of deforming the distal end of the salient 229. Furthermore, in place of the retaining portion, the electrode 310 may be bonded to the platen body 232 with an adhesive.

Moreover, the platen 230 provided with the electrode that is fixed to the platen body 232 as described above may be supplied as a single piece. In this manner, in the existing liquid ejecting apparatus provided with the electrode 310 as well, it is possible to prevent failure caused by a displacement of the electrode 310 due to electric field.

In addition, the ink jet recording apparatus, which is mounted in the multi functional printer 100 as the recording unit 110, is described as an example of the liquid ejecting apparatus here. However, the liquid ejecting apparatus may include an apparatus provided with a color material ejecting head, as a liquid ejecting head, used for manufacturing a color filter for a liquid crystal display, an apparatus provided with an electrode material (conductive paste) ejecting head, as a liquid ejecting head, used for forming an electrode for an organic EL display or a field emission display (FED), an apparatus provided with a bio-organic material ejecting head and a precision pipette, as a liquid ejecting head, used for manufacturing a bio-chip. In addition, the recording object generally indicates an object to which liquid ejected from a liquid ejecting head may be adhered. The recording object may include, in addition to the sheet of recording paper, a circuit board, a disc-shaped optical recording medium, a preparation, and the like.

Furthermore, the aspects of the invention are described using the embodiments, but the scope of the invention is not limited to the embodiments described above. It is apparent to a person skilled in the art that the above embodiments may be modified into various forms. In addition, the scope of the invention also encompasses such modified embodiments and will be apparent from the appended claims.

What is claimed is:

1. A liquid ejecting apparatus comprising:

a liquid ejecting head having a conductive nozzle plate that has openings, wherein the liquid ejecting head ejects liquid from the openings toward a front face of a recording object;

a platen that is arranged at a position opposed to the nozzle plate with the recording object placed between the platen and the nozzle plate, wherein the platen contacts a rear face of the recording object to support the recording object;

an absorption member that is arranged at a position opposed to the nozzle plate and located farther from the openings than the recording object in a direction in which the liquid is ejected, wherein the absorption member absorbs liquid that is ejected from the openings but not adhered to the recording object;

an electrode that is arranged in proximity to the absorption member; and a potential difference generating device that generates a difference in potential between the nozzle plate and the electrode by applying voltage to the electrode so as to form an electric field, whereby liquid ejected from the liquid ejecting head is electrically attracted toward the electrode, wherein the platen includes:

a platen body;

an accommodation portion that is depressed from the platen body and formed to include a bottom portion and a side wall portion, wherein the accommodation portion accommodates the absorption member therein, the side wall portion of the accommodation portion including a plurality of engaging pawls which engage with the absorption member; and a retaining portion that retains the electrode, which is arranged along the bottom portion of the accommodation portion, toward the bottom portion.

2. The liquid ejecting apparatus according to claim 1, wherein the retaining portion includes a protrusion that protrudes inward of the accommodation portion from portion of the side wall portion, wherein the electrode includes a cutout portion that allows the retaining portion to pass therethrough, and wherein the electrode, after accommodated in the accommodation portion by passing the protrusion through the cutout portion, is displaced along the bottom portion and then fitted between the bottom portion and the protrusion.

3. The liquid ejecting apparatus according to claim 1, wherein the retaining portion includes a protrusion that protrudes inward of the accommodation portion from portion of the side wall portion, wherein the electrode, after once contacting the protrusion, is pressed in so as to contact the bottom portion by overcoming elastic force of at least one of the electrode and the retaining portion and then held between the bottom portion and the retaining portion.

4. The liquid ejecting apparatus according to claim 1, wherein the retaining portion is formed to extend from the bottom portion and, after inserted through a hole formed in the electrode, contacts an upper face of the electrode by a top portion being deformed.

5. A liquid ejecting apparatus comprising:

a liquid ejecting head having a conductive nozzle plate that has openings, wherein the liquid ejecting head ejects liquid from the openings toward a front face of a recording object;

an absorption member that is arranged at a position opposed to the nozzle plate and located farther from the openings than the recording object in a direction in which the liquid is ejected, wherein the absorption member absorbs liquid that is ejected from the openings but not adhered to the recording object;

a platen that is integrally formed with a platen body, an accommodation portion and an electrode, wherein the accommodation portion is depressed from a surface of the platen body, wherein the accommodation portion accommodates the absorption member therein, wherein the electrode is at least partially embedded in a bottom portion of the accommodation portion, wherein the platen is arranged at a position opposed to the nozzle plate with the recording object placed between the platen and the nozzle plate, and wherein the platen contacts a rear face of the recording object to support the recording object; and a potential difference generating device that generates a difference in potential between the nozzle plate and the electrode by applying voltage to the electrode so as to form an electric field, whereby liquid ejected from the liquid ejecting head is electrically attracted toward the electrode, wherein the accommodation portion includes a bottom portion and a side wall portion, the side wall portion including a plurality of engaging pawls which engage with the absorption member.

6. A liquid ejecting apparatus comprising:

a liquid ejecting head having a conductive nozzle plate that has openings, wherein the liquid ejecting head ejects liquid from the openings toward a front face of a recording object;

an absorption member that is arranged at a position opposed to the nozzle plate and located farther from the openings than the recording object in a direction in which the liquid is ejected, wherein the absorption member absorbs liquid that is ejected from the openings but not adhered to the recording object;

a platen that is integrally formed with a platen body and an accommodation portion, wherein the accommodation portion is depressed from a surface of the platen body, wherein the accommodation portion accommodates the absorption member therein, wherein the platen is arranged at a position opposed to the nozzle plate with the recording object placed between the platen and the nozzle plate, and wherein the platen contacts a rear face of the recording object to support the recording object;

an electrode that is adhered to a bottom portion of the accommodation portion; and a potential difference generating device that generates a difference in potential between the nozzle plate and the electrode by applying voltage to the electrode so as to form an electric field, whereby liquid ejected from the liquid ejecting head is electrically attracted toward the electrode, wherein the accommodation portion includes a bottom portion and a side wall portion, the side wall portion including a plurality of engaging pawls which engage with the absorption member.

* * * * *